United States Patent [19]

Yamamura et al.

[11] Patent Number: 4,534,590

[45] Date of Patent: Aug. 13, 1985

[54] CHAIR WITH A BACK FOR RECLINING

[75] Inventors: Yukio Yamamura, Hikone; Jingo Nakayama, Shiga; Atsunobu Ikeda; Takashi Kawamoto, both of Hikone, all of Japan

[73] Assignee: Matsushita Electric Works, Ltd., Osaka, Japan

[21] Appl. No.: 499,878

[22] Filed: Jun. 1, 1983

[30] Foreign Application Priority Data

Jun. 15, 1982 [JP] Japan ..... 57-102721

[51] Int. Cl.[3] ..... A47C 7/72

[52] U.S. Cl. ..... 297/180; 297/423; 297/118

[58] Field of Search ..... 297/423, 429, 180, 195, 297/105, 118, 335, 336

[56] References Cited

U.S. PATENT DOCUMENTS

| | | | |
|---|---|---|---|
| 98,973 | 1/1870 | Joeckel | 297/118 |
| 2,692,639 | 10/1954 | Genovese | 297/105 |
| 3,669,493 | 6/1972 | Vowles | 297/429 |
| 3,863,978 | 2/1975 | Gillings | 297/195 |
| 3,970,345 | 7/1976 | Holcomb | 297/195 |
| 4,328,991 | 5/1982 | Mengshoel et al. | 297/423 |
| 4,335,725 | 6/1982 | Geldmacher | 297/180 |

FOREIGN PATENT DOCUMENTS 961755 1/1975 Canada .

*Primary Examiner*—Francis K. Zugel

*Attorney, Agent, or Firm*—Stevens, Davis, Miller & Mosher

[57] ABSTRACT

The present invention is directed toward an orthopedically improved chair that is designed so as to prevent pain in the waist or back of the user. In one embodiment of the present invention, the chair is adaptable for use as either a squat chair or a conventional type chair. The chair of this embodiment is characterized by a seat that is freely forwardly downwardly inclinable to a point about 20° below the horizontal; and a forwardly protruding cross-bar portion that provides support for the lumbar region of the spine. In addition, this chair can be adapted for use as a conventional type chair by merely moving the downwardly inclinable seat into its vertical position and then using the base of the chair as a seat.

12 Claims, 16 Drawing Figures

CHAIR WITH A BACK FOR RECLINING

BACKGROUND OF THE INVENTION

I. Field of the Invention

The present invention relates to a chair which prevents pain in the waist or back of a person using the chair, and is adapted so as to enable a person to sit on the chair in a comfortable posture for a long period of time.

II. Prior Art

In modern life wherein the use of chairs is indispensible, the waist or back pain experienced by persons using chairs has remarkably increased. The anatomical factors leading to this waist and back pain can be briefly explained as follows. The human spine in the waist region, as shown in FIG. 13(*a*), includes the lumbar portion of the spine 18 and the sacral portion of the spine 20. When a person sits on a conventional chair with a horizontal seat A, the lumbosacral angle $\theta_1$ between the center line of the lowermost lumbar vertebra 18 and the center line of the sacral portion of the spine 20, as shown in FIG. 13(*b*), becomes larger than that seen when a person is in the standing position (the condition of the sacral portion of the spine 20 when a person is in the standing position is illustrated by the broken line in FIG. 13(*b*)). This increase in the lumbosacral angle is accompanied by a decrease in the space between the lowermost lumbar vertebra 18 and the sacral portion of the spine 20, so that the intervertebral disc 19 experiences an exertion of pressure on one side thereof. This exertion of pressure stimulates the spinal nerves, thereby causing the waist or back pain of a person sitting in the chair.

Various solutions have been proposed in order to solve the above-discussed problem. For example, Canadian Pat. No. 961,755 discloses a chair whose seat is inclined forwardly downwardly so as to reduce the lumbosacral angle in the spine of a person sitting in the chair. However, this chair has as a significant drawback the fact that a person sitting in the chair is liable to bend his latissimus dorsi, the result being that the lumbar portion of this person's spine is bent in a manner which does not prevent waist or back pain from occurring.

SUMMARY OF THE INVENTION

In light of the above-discussed problem, the chair of the present invention has been designed. A principal object of the present invention is to provide a chair which prevents the exertion of pressure upon the lumbosacral intervertebral disc of the user, thereby preventing pain in the waist and back of the user, so that the user can sit on the chair in a comfortable posture.

Another object of the present invention is the provision of a chair suitable for use as a squat chair.

DETAILED DESCRIPTION OF THE INVENTION

An embodiment of the chair of the present invention will now be described, with reference being made to the accompanying drawings.

Figure 1:
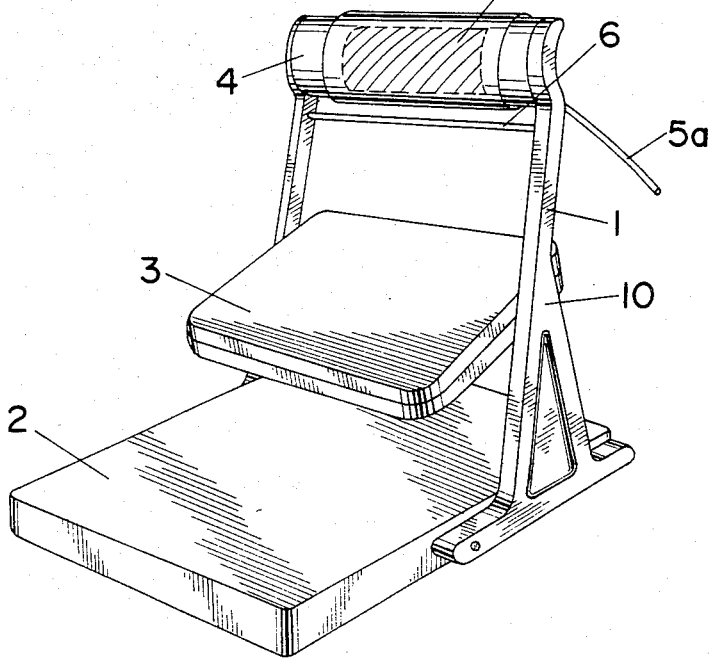
FIG. 1 is a perspective view of an embodiment of the chair of the present invention.

FIG. 1 is a perspective view of an embodiment of the chair of the present invention, in which reference numeral 1 designates a reclining frame that is constructed of a strong material such as wood, steel or metal pipes. A base 2 is provided at the lower end of the reclining frame 1. The base 2 is somewhat tapered so that it becomes gradually greater in thickness toward its front portion. A seat 3 is pivotally supported at opposite side portions thereof by an intermediate portion of respective side bars of the reclining frame 1, thereby being swingable. A lumbar supporting cross-bar portion 4 protrudes toward the front portion of the frame 1 and abuts against the waist of the user so as to prevent the lumbar portion of the spine from bending, so that the user can sit on the chair in a comfortable manner. A heater 5 has a power supply cord 5*a* detachably mounted thereto. In addition, a support rod 6 abuts against the end portion of seat 3 when it swings upwardly and leans toward the reclining frame 1, thereby restricting the seat 3 in this position.

Figure 2:
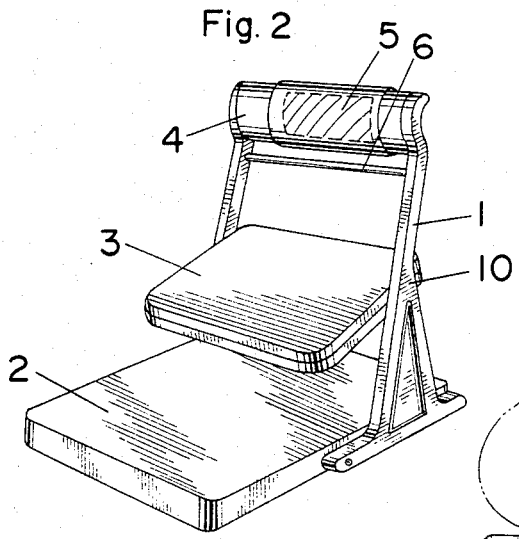
FIGS. 2 and 3 are perspective and side views of the embodiment illustrated in FIG. 1, showing the chair when in use as a squat chair.
Figure 3:
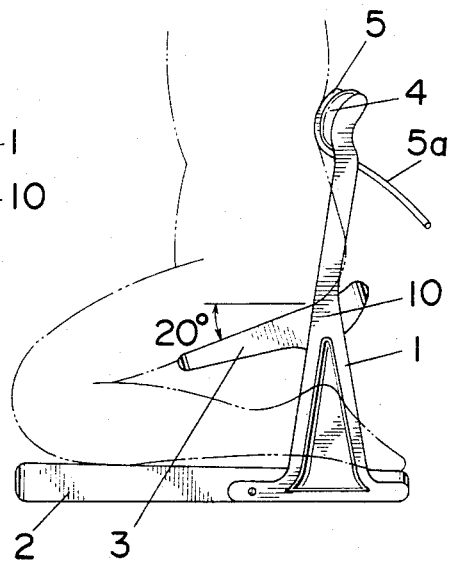
Figure 13:
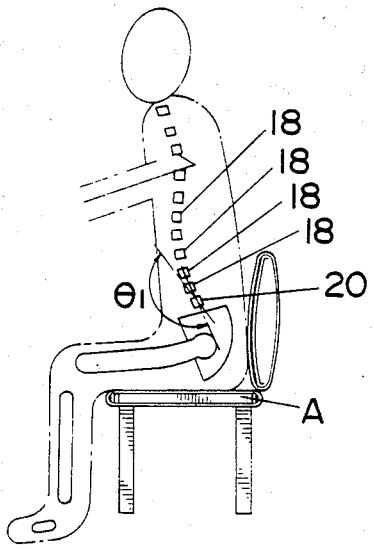
FIGS. 13(*a*) and (*b*) are views explaining the operation of a conventional chair.
Figure 13:
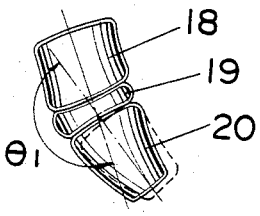
PRIOR ART Fig. 13 (b)
Figure 14:
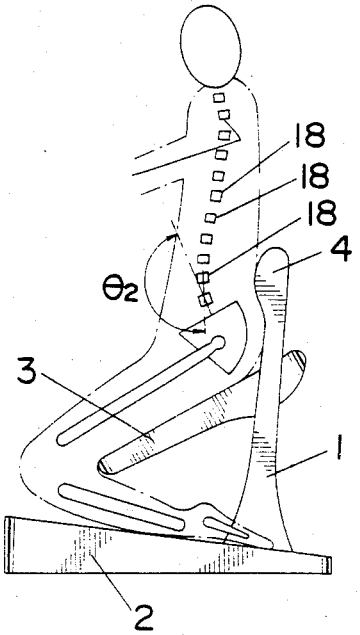
FIGS. 14(*a*) and (*b*) are explanatory views of the operation of the chair of the present invention.
Figure 14:
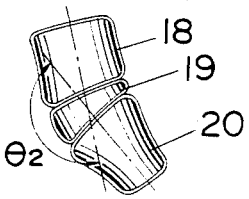

FIGS. 2 and 3 are perspective and side views, respectively, of an embodiment of the chair of the present invention when in use as a squat chair. These views illustrate that the seat 3 is adapted so as to be fixable in a position wherein it is inclined forwardly downwardly at an angle of about 20° with respect to the horizontal. In use, a person will sit on the seat 3 and bend his or her legs so as to be inserted between the seat 3 and the base 2, at which time the lumbar supporting cross-bar portion 4 abuts against his or her waist so as to prevent bending of the lumbar region of the spine. Also, the heater 5 mounted on the cross-bar portion 4 provides a warming curative treatment, thereby making it possible to further relieve any waist or back pain the user of the chair may be experiencing. When a user of the chair is in the position illustrated in FIG. 3, the skeleton of that person will be in the condition shown in FIGS. 14(*a*) and (*b*). Consequently, the lumbosacral angle $\theta_2$ of this person's spine is less than that of the person illustrated in FIG. 13, the result being that the intervertebral disc 19 is not pressed and therefore does not readily give rise to pain in the waist of the user.

Figure 4:
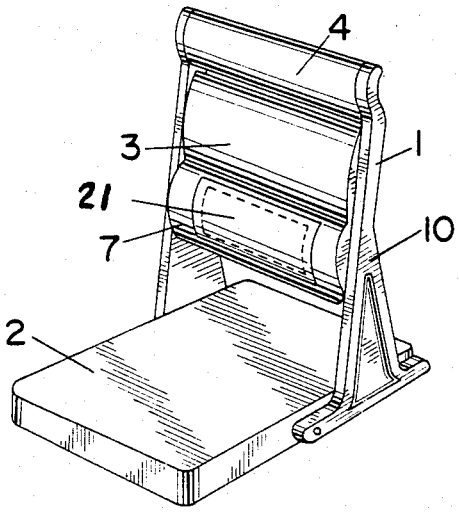
FIGS. 4 and 5 are perspective and side views of the embodiment illustrated in FIG. 1, showing the chair when in use as a conventional chair.
Figure 5:
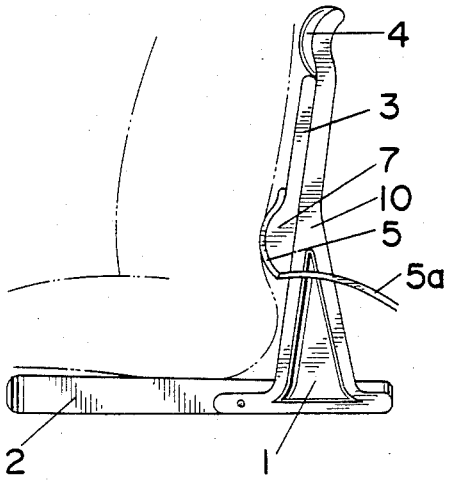

FIGS. 4 and 5 are perspective and side views, respectively, of an embodiment of the chair of the present invention when in use as a conventional chair. In this case, the seat 3 of the chair is raised when in use and leans against the reclining frame 1. At the rear bottom portion of the seat 3, a lumbar supporting protruding portion 7 is provided for supporting the waist of the user. A heater 21, which helps alleviate pain in the waist of the user by means of a warming curative treatment, is provided on the swollen portion 7. The lumbar supporting protruding portion 7, seat 3, base 2 and lumbar supporting cross-bar 4 are made from wood, cushion materials and cloth, and have a degree of moderate elasticity so as to make the chair comfortable to sit on.

Figure 6:
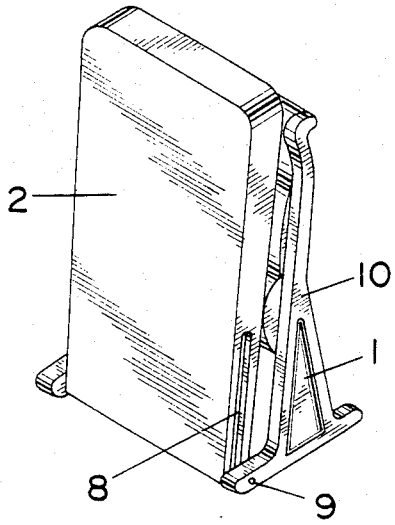
FIGS. 6 and 7 are perspective and side views of the embodiment illustrated in FIG. 1, showing the chair in its folded storage position.
Figure 7:
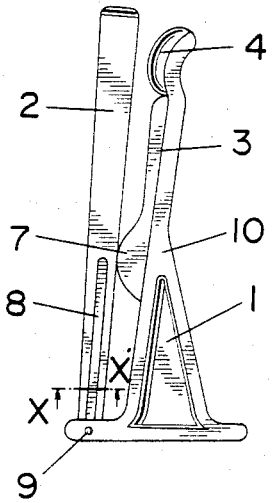

FIGS. 6 and 7 are perspective and side views, respectively, of an embodiment of the chair of the present invention when it is folded so as to be stored while not in use. When the chair is not in use, the base 2 is drawn forwardly through grooves 8 provided at both sides of the rear portion of the base 2 and is then turned upwardly around projections 9 at both lower side portions of frame 1 and leans thereagainst. In its folded condition, the chair is compact and can be easily put away and stored.

Figure 8:
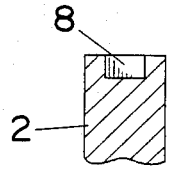
FIG. 8 is a sectional view taken on the line X—X in FIG. 7.

FIG. 8 shows the groove 8 provided at each side of the rear portion of the base 2, the projections 9 being fitted into respective grooves 8.

Figure 9:
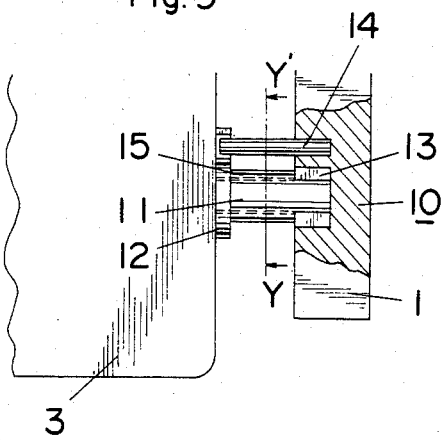
FIG. 9 is a partially cutaway rear view of a pivotally supporting portion of the chair located between the seat and a reclining frame.
Figure 10:
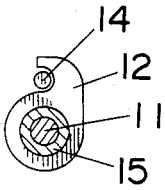
FIG. 10 is a sectional view taken on the line Y—Y in FIG. 9.

Referring now to FIGS. 9 and 10, the construction of each pivotally supporting portion 10 is illustrated. This construction comprises a shaft 11, which projects from the seat 3 and is fixed at the root of a locking fitting 12, interposed between each side bar of the reclining frame 1 and the seat 3. The reclining frame 1 provides a bearing 13 for shaft 11 and a stopper rod 14 for stopping rotation, so that the locking fitting 12 engages with the rod 14 to thereby keep the seat 3 stationary in a condition of inclining forwardly downwardly at an angle of about 20° with respect to the horizontal. In addition, a collar 15 sleeved on the shaft 11 is interposed between the seat 3 and the reclining frame 1 in order to maintain a moderate gap therebetween. Alternatively, a twisted spring or a coil spring may be provided at each pivotally supporting portion 10 in order to bias seat 3 upwardly, thereby enabling the seat 3 to automatically return toward the reclining frame 1.

Figure 11:
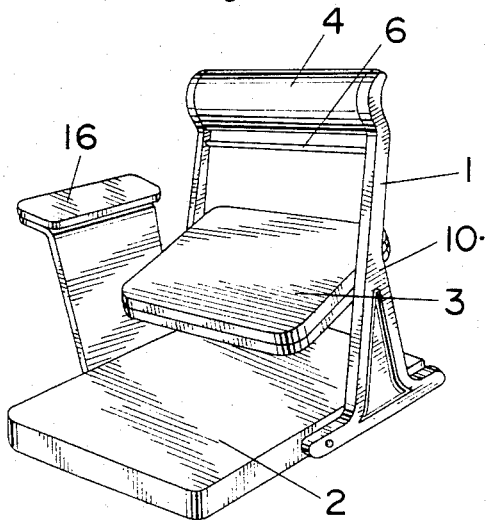
FIGS. 11 and 12 are perspective views of modified embodiments of the chair of the present invention.
Figure 12:
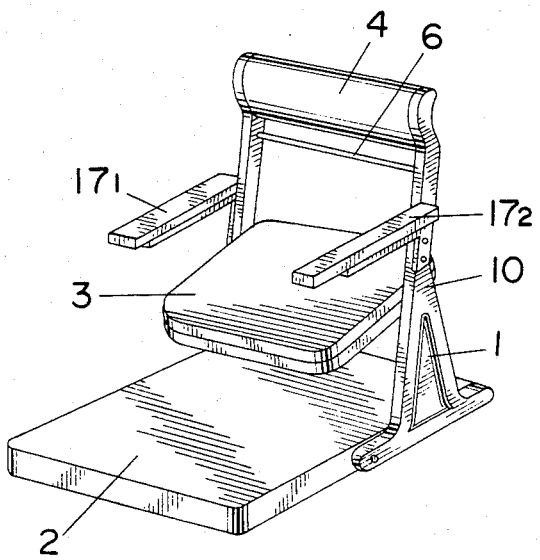

FIGS. 11 and 12 illustrate modified embodiments of the chair of the present invention. In the embodiment illustrated in FIG. 11, the chair is provided, at one side of the base 2, with a leg rest 16. The emnbodiment illustrated in FIG. 12 is provided with elbow rests 17 at both sides of the reclining frame 1, these elbow rests 17 being attached to the frame by means of screws.

The foregoing description illustrates that the lumbosacral angle of a person using a chair constructed in accordance with the foregoing description is relatively smaller than that seen in a person using a chair having a conventional construction. In addition, the waist of a person using the chair of the present invention is supported by the protruding cross-bar portion, whereby the line of the person's backbone is relatively straight and the lumbar portion of the spine is not bent. As a result, the lumbosacral intervertebral disc is not subjected to excessive pressure, and the user of the chair does not experience waist or back pain. Moreover, a person using the chair of the present invention can remain relatively free of waist or back pain even when sitting for a long period of time.

Having described a preferred embodiment of the present invention, it will be apparent to those skilled in the art that obvious variations can be made in view of the above description to obtain the benefits thereof.

We claim:

1. A chair which may be used either as a squat chair or a conventional chair comprising:

a frame member, said frame member having a cross-bar portion at its upper end and a pair of side bars extending downwardly from respective ends of the cross-bar portion, said cross-bar portion being located so as to abut against the waist region of the back of a person sitting on the chair, thereby supporting the lumbar region of the person's spine;

a seat member, said seat member being pivotally supported at opposite sides thereof on respective side bars of said pair of side bars;

pivotal support means, said support means pivotally supporting the seat member on the frame member so that the seat member is freely forwardly downwardly inclinable, said support means including means for limiting the angle of downward inclination of the seat member;

a substantially planar base, said base being attached to the side bars of the frame member at the lower ends thereof; and further comprising a lumbar supporting protruding portion at the rear bottom portion of the seat member, said protruding portion being located so as to abut against the waist region of the back of a person sitting on the base when the seat member is in an upright position, thereby supporting the lumbar region of the person's spine.

2. The chair according to claim 1, further comprising heating means located on the cross-bar portion.

3. The chair according to claim 1, further comprising means for slidably attaching the base to the frame member, said means comprising grooves at the rear side portions of the base and projections at the lower inside portion of the side bars, said grooves and said projections cooperating so that the base can be drawn forward and then turned upwardly toward the frame member.

4. The chair according to claim 1, further comprising means for supporting the forward end portion of the seat member when the seat member is in an upright position.

5. The chair according to claim 1, further comprising heating means located on at least one of the lumbar supporting protruding and cross-bar portions.

6. The chair according to claim 1, further comprising a leg rest attached to one side of the base.

7. The chair according to claim 1, further comprising at least one elbow rest attached to the side of the frame member.

8. The chair according to claim 1, wherein said pivotal support means comprises pivot point means located on the sides of the seat member and the side bars of the frame member, said pivot point means including projections extending from respective sides of the seat member to respective side bars of the frame member; and said means for limiting the downward inclination of the seat member comprises a stop means, said stop means having complementary mating parts located on the sides of the seat member and on the side bars of the frame member.

9. The chair according to claim 8, further comprising a collar sleeved on the pivot point projections, said collar being interposed between the seat member and the side bars of the frame member so that a moderate gap is maintained therebetween.

10. The chair according to claim 8, further comprising spring means for biasing the seam member upwardly, thereby enabling the seam member to return toward the frame member.

11. A chair comprising:

a substantially planar rectangular base;

a frame member attached to the base, said frame member having a pair of upstanding side bars substantially perpendicular to and extending upwardly from respective sides of the base, a forwardly protruding cross-bar portion at the upper ends of said side bars, said cross-bar portion being located so as to abut against the waist region of the back of a person sitting on the chair, thereby supporting the lumbar region of the person's spine;

a substantially planar seat member, said seat member being pivotally supported at opposite sides thereof on respective side bars of said pair of side bars, said seat member having a protruding portion at the rear bottom portion thereof, said protruding portion being located so as to abut against the waist region of the back of a person sitting on the base when the seat member is in an upright position, thereby supporting the lumbar region of the person's spine;

heating means located on at least one of the forwardly protruding cross-bar and protruding seat member portions; and support means, said support means pivotally supporting the seat member on the frame member so that the seat member is freely forwardly downwardly inclinable and is fixable at a point about 20° below the horizontal, said support means including means for supporting the forward end portion of the seat member when the seat member is in an upright position.

12. The chair according to claim 11, further comprising means for slidably attaching the base to the frame member, said means comprising grooves at the rear side portions of the base and projections at the lower inside portion of the side bards, said grooves and said side bars cooperating so that the base can be drawn forward and then turned upwardly toward the frame member.

* * * * *